US006050643A

United States Patent [19]

Kain et al.

[11] Patent Number: 6,050,643

[45] Date of Patent: Apr. 18, 2000

[54] JUVENILE CHAIR

[75] Inventors: James M. Kain, Tipp City, Ohio; Michael S. Rosko, Greenwood, Ind.

[73] Assignee: Cosco, Inc., Columbus, Ind.

[21] Appl. No.: 09/092,216

[22] Filed: Jun. 5, 1998

Related U.S. Application Data

[60] Provisional application No. 60/048,775, Jun. 6, 1997.

[51] Int. Cl.[7] ..... A47C 3/40

[52] U.S. Cl. ..... 297/344.18; 297/377; 297/151; 297/183.3; 297/130; 297/344.14

[58] Field of Search ..... 297/344.12, 344.13, 297/344.14, 344.1, 148, 153, 118, 130, 250.1, 344.18, 338, 354.12, 377, 183.1, 183.6, 183.3, 183.4, 256.16, 151

[56] References Cited

U.S. PATENT DOCUMENTS

| | | |
|---|---|---|
| D. 365,936 | 1/1996 | Haut et al. . |
| 1,200,693 | 10/1916 | Barton et al. . |
| 1,699,309 | 1/1929 | Powers . |
| 2,702,072 | 2/1955 | Shuessler . |
| 4,105,247 | 8/1978 | Saint . |
| 4,534,072 | 8/1985 | Lipski . |
| 4,568,120 | 2/1986 | Hoffman . |
| 4,603,902 | 8/1986 | Maloney . |
| 4,722,570 | 2/1988 | Bertoli . |
| 4,738,487 | 4/1988 | Shalinsky et al. . |
| 4,938,603 | 7/1990 | Turner et al. . |
| 5,165,755 | 11/1992 | Rho . |
| 5,183,311 | 2/1993 | Meeker et al. . |
| 5,238,292 | 8/1993 | Golenz et al. . |
| 5,332,241 | 7/1994 | Rho . |
| 5,445,432 | 8/1995 | Chien . |
| 5,483,901 | 1/1996 | Tisbo et al. . |
| 5,489,138 | 2/1996 | Mariol et al. . |
| 5,507,550 | 4/1996 | Maloney . |
| 5,509,719 | 4/1996 | Cone, II . |
| 5,558,400 | 9/1996 | Poulson et al. . |
| 5,782,532 | 7/1998 | Opsvik . |
| 5,810,432 | 9/1998 | Haut et al. . |

OTHER PUBLICATIONS

RIGHT HEIGHT™ (270195) and CELEBRITY™ (271181) Evenflo product advertisement, one page, date unknown.

385 Gerry™ Adjust–a–Height® Chair, 1994 Catalog, two pages.

Kolcraft® Perfect Height™, two pages, 1993.

Aprica® Bed and Breakfast Two–in–one infant seat/cradle and high chair, two pages, date unknown.

The Versstile, Adjustable High Chair, Infantino Product Catalogue, three pages, 1994.

Playskool® High Chair™, BabyCare Products 1994, three pages.

Cosco® Options 5™ High Chair, four pages, 1998.

*Primary Examiner*—Milton Nelson, Jr.
*Attorney, Agent, or Firm*—Barnes & Thornburg

[57] ABSTRACT

A juvenile chair is provided for seating a child. The chair includes a frame, a seat mounted on the frame for sliding movement along the frame, and a height-adjustment mechanism formed to fix the seat in a selected elevation on the frame. The frame includes a guide channel and the seat includes a track guide that slides in the guide channel. The frame further includes height-adjustment slots into which the height-adjustment mechanism locks at each respective elevation.

92 Claims, 13 Drawing Sheets

10
14
46
70
80
72
78
66
76
68
128
122
132
124
130
45
44
228
212
214
242
96
104
98
100
92
94
102
110
106
40
42
108
126
174
182
17
168
194
190
180
198
178
200
172
204
210
202
208
234
177
176
188
192
186
184
170
230
112
118
64
114
60
53
146
144
143
140
16
148
152
166
142
154
162
164
160
54
116
156
120
50
158
12
59
264
65
90
52
86
84
56

14
46
74
71
70
80
71
72
74
80
66
76
82
49
47
49
47
164
162
10
122
128
16
152
68
254
226
142
182
246
244
140
124
144
130
17
250
226
254
246
250
122
128
16
45
160
174
188
168
180
186
44
178
200
172
180
162
142
170
230
192
206
210
200
224
160
140
144
204
212
214
202
178
164
152
110
92
202
176
232
130
218
98
172
168
176
186
94
236
232
184
40
92
17
190
220
98
94
206
230
198
170
42
118
236
184
108
116
114
112
114
112
114
112

JUVENILE CHAIR

This claims priority under 35 U.S.C. §119(e) of Ser. No. 60/048,775 filed Jun. 6, 1997.

BACKGROUND AND SUMMARY OF THE INVENTION

This invention relates to a juvenile chair, and particularly to a juvenile chair having a seat that can be moved relative to a frame between elevated and lower positions. More particularly, the present invention relates to a foldable plastic juvenile chair having a seat that is movable generally vertically from a lowered position to a raised position and that is capable of assuming a reclined position.

Juvenile high chairs are widely accepted as necessary appliances for seating young children comfortably during a meal or other activity. Chairs that are movable to assume different elevations and orientations are known in the art. See, for example, U.S. Pat. No. 5,183,311 to Meeker et al. and U.S. Pat. No. 5,509,719 to Cone, II.

According to the present invention, a juvenile chair includes a frame, a seat movable on the frame, and a height-adjustment mechanism configured to fix the seat in a selected elevation on front legs of the frame. The front legs of the frame have an upper portion, a lower portion, guide channels, and height-position slots separate from the guide channels. The guide channels of the front legs are configured for guiding inclined reciprocating movement of the seat on the frame relative to the upper and lower portions. In addition, the height-position slots are configured for fixing the height-adjustment mechanism at a pre-determined elevation on the frame between the upper and lower portions.

In preferred embodiments, the seat of the juvenile chair includes track guides that ride within the guide channels between the upper and lower portions of the front legs. Each track guide includes a plate extending from the seat, a lower guide post, and an elongated guide block. The guide post and guide block each extend outwardly from the plate and slide in the guide channels of the front legs during sliding movement of the seat on the frame.

The height-adjustment mechanism of the juvenile chair includes spaced-apart latches. Each latch has an outer latch button and an inner latch with a latch tooth sized to fit into the height-position slots. The latch tooth includes a cam surface to permit ramping upward movement of the seat to a higher elevation without manual actuation of the outer latch button. In addition, the tooth includes a flat locking surface facing in an opposite direction from the cam surface to block downward movement of the seat on the frame unless the spring-biased outer latch buttons are simultaneously manually actuated.

In preferred embodiments, the seat may be mounted upon the frame in a reclined position. The frame includes a handle portion extending between the front legs and the seat includes a handle that is coupled to the handle portion of the frame when the seat is mounted on the frame in the reclined position. In addition, locking pins extend through the track guides and into the guide channels of the frame to prevent the seat from pivoting about the handle portion of the frame.

Additional features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
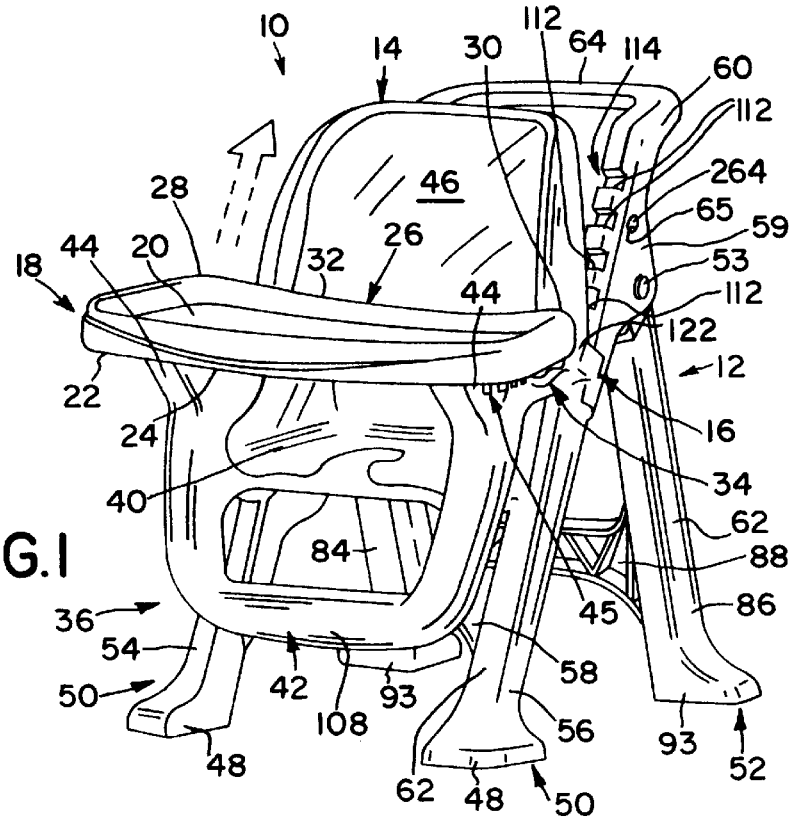
FIG. 1 is a perspective view of a juvenile chair in accordance with the present invention showing the chair including a frame having front legs with a plurality of height-position slots therein and rear legs, a seat, and a height-adjustment mechanism coupled to the seat and engaging one of the height-position slots to mount the seat in a fully-lowered position on the frame and showing a tray assembly mounted on the seat.
Figure 2:
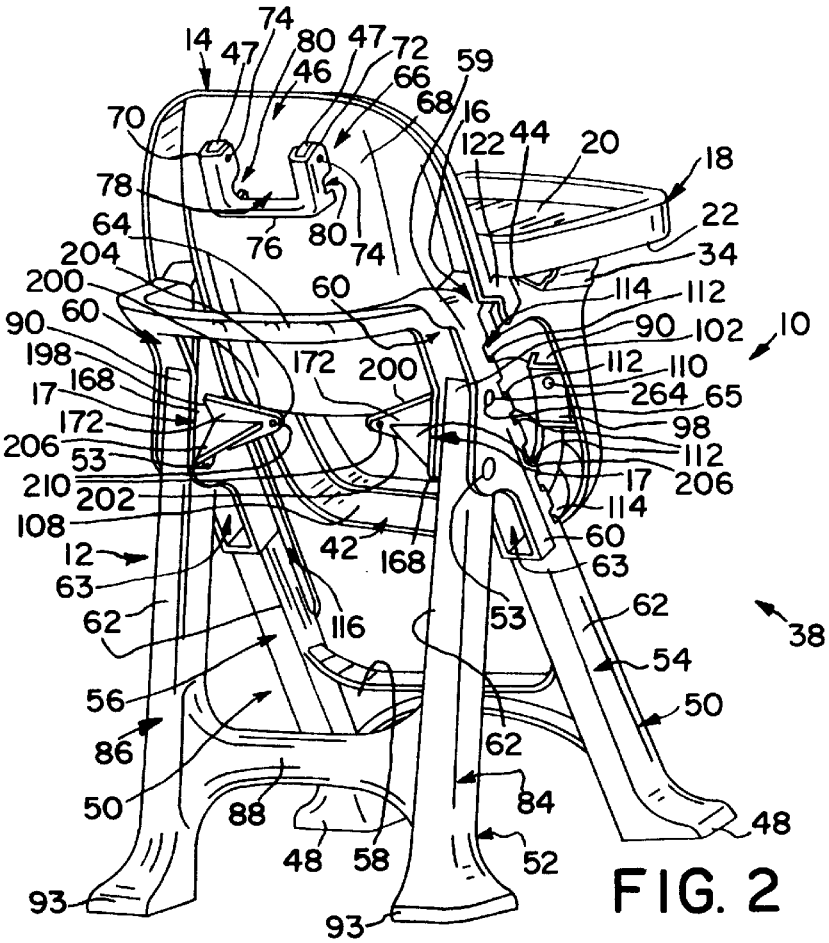
FIG. 2 is a rear perspective view of the juvenile chair of FIG. 1 showing the seat in a fully-elevated position on the frame.
Figure 3:
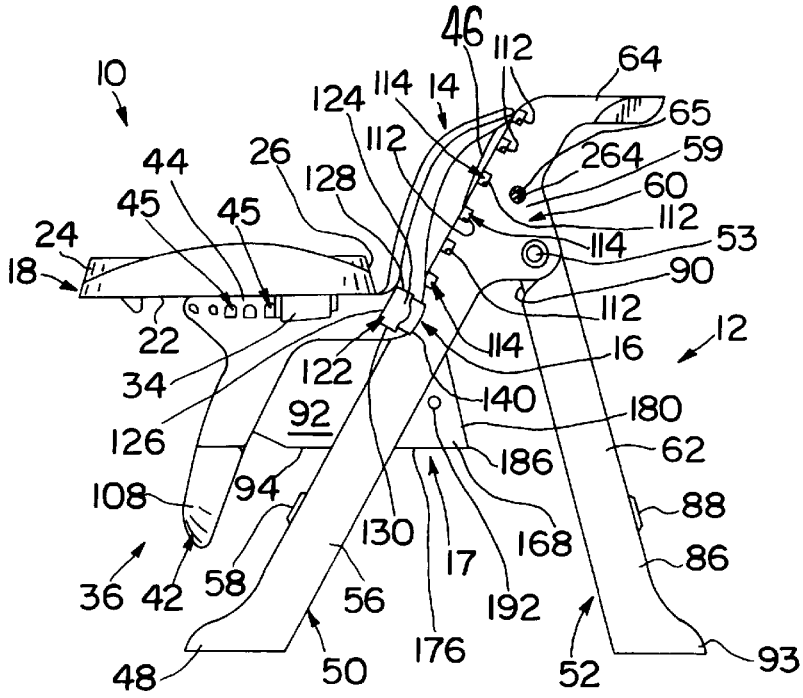
FIG. 3 is a side view of the juvenile chair of FIG. 1 showing the seat in its fully-lowered position wherein the height-adjustment mechanism engages a lowest of seven height-position slots formed in the front legs.
Figure 4:
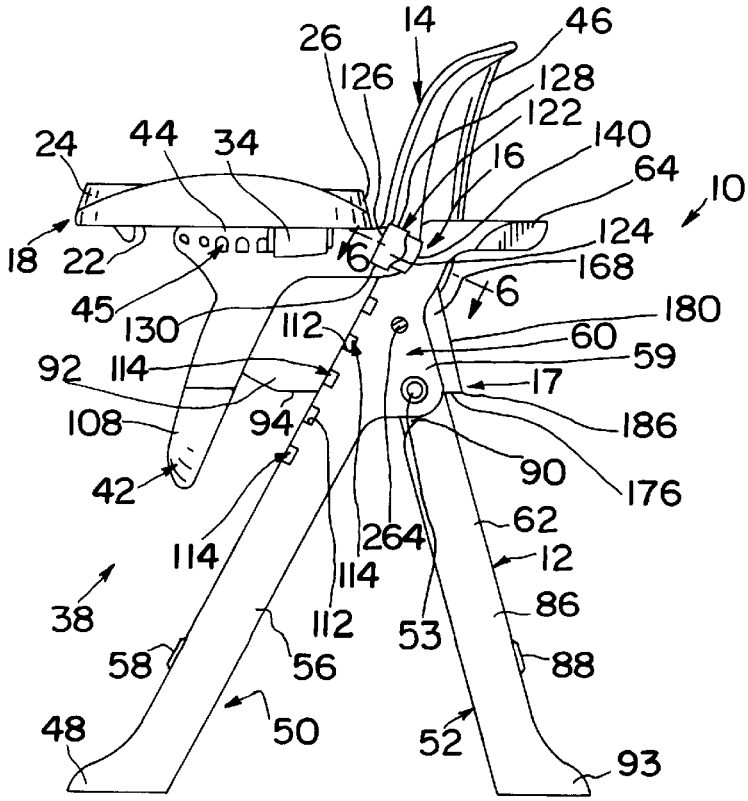
FIG. 4 is a side view of the juvenile chair of FIG. 2 showing the seat in its fully-elevated position wherein the height-adjustment mechanism engages a highest of seven height-position slots formed in the front legs.

A juvenile chair 10 in accordance with the present invention is shown in FIG. 1. Chair 10 provides a frame 12, a seat 14 mounted for sliding movement upon frame 12, and a height-adjustment mechanism 16 formed to fix seat 14 in a selected elevation on frame 12. Seat 14 slides on frame 12 to move between a fully-lowered position 36 as shown in FIGS. 1 and 3 and a fully-elevated position 38 as shown in FIGS. 2 and 4. Sliding movement of seat 14 allows the caregiver to adjust easily vertical positioning of seat 14 on frame 12. Height-adjustment mechanism 16, however, blocks seat 14 from freely sliding downwardly toward fully-lowered position 36, while permitting seat 14 to be ramped in a generally vertically upward direction toward fully-elevated position 38.

Seat 14 of juvenile chair 10 is coupled selectively to tray assembly 18, which is configured to slide relative to frame 12. Incorporated by reference herein are U.S. patent applications entitled "Tray Assembly with Crotch Post" to James M. Kain and Michael S. Rosko filed herewith and "Release Mechanism for Tray" to James M. Kain and Michael S. Rosko filed herewith. As shown in FIG. 1, tray assembly 18 includes a tray top 20, a tray bottom 22, a convex outward edge 24 extending outwardly over frame 12, and an opposite inward edge 26. Inward edge 26 includes opposite ends 28, 30 and a concave child-receiving edge 32 extending between ends 28, 30. Child-receiving edge 32 allows opposite ends 28, 30 of inward edge 26 to lie close to seat 14 while still allowing a smaller child (not shown) to sit comfortably on seat 14. Tray assembly 18 also includes a latch 34 that selectively couples tray bottom 22 on seat 14. While tray assembly 18 is illustrated and described, it is understood that a wide variety of trays may be used with seat 14 or juvenile chair 10 in accordance with the present invention.

Seat 14 as it would appear in fully-lowered position 36 upon frame 12 is shown in FIGS. 1 and 3. Fully-lowered position 36 gives a child the ability to sit adjacent a low surface, such as floor, an end table, or a coffee table (not shown). Seat 14 as it would appear in fully-elevated position 38 is shown in FIGS. 2 and 4. Referring now to FIG. 4, seat 14 in fully-elevated position 38 lies generally vertically upwardly and spaced-apart relative to fully-lowered position 36. Fully-elevated position 38 gives a child the ability to sit adjacent a kitchen/dining room table (not shown) or the like. Seat 14 may slide on frame 12 between fully-elevated position 38 and fully-lowered position 36. In addition, it is understood, that seat 14 may be positioned to lie in a number of positions between fully-elevated and fully-lowered positions 38, 36.

Figure 5:
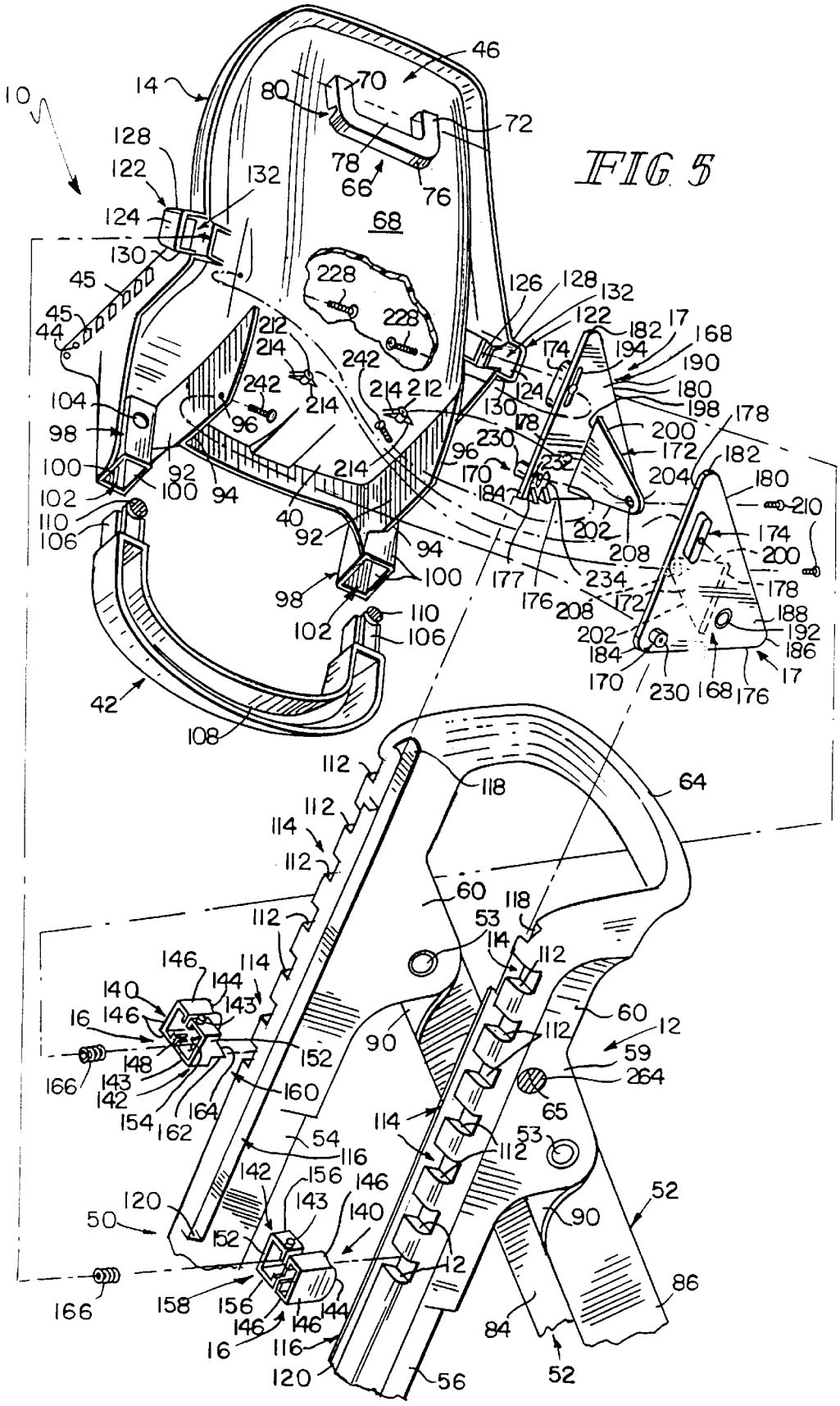
FIG. 5 is an exploded assembly view of the frame and seat of the juvenile chair of FIG. 1 showing a guide channel formed in each of the front legs and two track guides adapted to be coupled to a back side of the seat, each track guide including a generally round guide post and an elongated block mounted on a triangle-shaped plate and configured to slide back and forth in one of the guide channels.

Seat 14 includes a seat bottom 40, a seat back 46 extending upwardly from seat bottom 40, and elevated arms 44 extending between seat bottom 40 and seat back 46 for supporting tray assembly 18. Track guides 17 are coupled to seat back 46 and formed to direct sliding movement of seat 14 on frame 12. Arms 44 are configured to include apertures 45 sized to receive and lock latch 34 of tray assembly 18 to seat 14. As shown in FIG. 3, seat 14 also includes mounting panels 92 that are coupled to track guides 17 to stabilize track guides 17 relative to seat back 46. As shown in FIG. 5, mounting panels 92 include a bottom edge 94 and an aperture 96 that is positioned to lie adjacent bottom edge 94.

A foot rest 42 can be snapped onto to seat 14 and can be detached by push buttons 110 to extend the useful life of juvenile chair 10 once the child's legs (not shown) have grown past foot rest 42. For example, once foot rest 42 is removed, seat 14 may still be positioned in the fully-lowered position 36 and the child's feet may rest upon the floor. In addition, seat 14 may also be removed from frame 12 and placed upon the floor (not shown) or upon stationary chair 216 (FIG. 14) for use as a booster seat apart from frame 12.

As shown in FIG. 5, seat 14 includes post-receiving portions 98 that selectively receive foot rest 42 to couple seat bottom 40 to foot rest 42. Each post-receiving portion 98 includes panels 100 that define a passageway 102 therebetween and a hole 104 that extends through one panel 100. Foot rest 42 includes opposite end portions 106 sized for extension into passageway 102 of post-receiving portion 98 and middle portion 108 that extends between opposite end portions 106. Opposite end portions 106 each include push button 110 that is sized to snap into hole 104 of post-receiving portion 98 to couple selectively foot rest 42 to post-receiving portion 98 of seat 14. Foot rest 42 may be formed in a variety of shapes and be coupled to seat 14 using a wide variety of attachment mechanisms in accordance with the present invention.

As shown in FIGS. 1 and 2, frame 12 supports seat 14 both in fully-elevated and fully-lowered positions 38, 36. Frame 12 includes a front frame member 50 pivotally coupled to a rear frame member 52 by a pivot post 53. Front frame member 50 includes two angled front legs 54, 56. A lower support member 58 extends between front legs 54, 56 generally perpendicular to legs 54, 56. Front legs 54, 56 each have an upper portion 60 and a lower portion 62 having a foot 48. Upper portion 60 defines a cavity 63 therein and includes a side wall 59 having an aperture 65 therethrough. As shown in FIG. 2, a handle portion 64 extends between front legs 54, 56.

Front legs 54, 56 are also each formed to include a guide channel 116 for guiding inclined reciprocating movement of seat 14 relative to frame 12. Guide channel 116 is shown in FIG. 5 and includes a first end 118 adjacent handle portion 64 and a second end 120 positioned to lie within lower portion 62 spaced apart from foot 48. Moreover, each guide channel 116 is formed to receive track guides 17 of seat 14 therein so that seat 14 rides on front legs 54, 56 in a generally straight manner between fully-lowered position 36 and fully-elevated position 38.

Front legs 54, 56 each include height-position slots 114 that are defined by locking surfaces 112 to mount seat 14 on frame 12 in a plurality of pre-determined elevated positions. Slots 114 open forward and outward and are outside guide channels 116. Slots 114 are sized to permit extension of height-adjustment mechanism 16 therein so that seat 14 is held in a variety of elevated positions on frame 12 between fully-lowered position 36 and fully-elevated position 38. As shown in FIG. 5, front legs 54, 56 each include seven height-position slots 114 therein. It is understood, however, that greater or fewer than seven slots 114 may be included in front legs 54, 56 in accordance with the present invention.

As shown in FIG. 2, rear frame member 52 is mounted within upper portion 60 of front legs 54, 56 to support frame 12 in an expanded position 280. Rear frame member 52 includes rear legs 84, 86 and a lower support member 88 that extends between rear legs 84, 86. Rear legs 84, 86 each have an upper portion 90 positioned to lie within cavity 63 of front legs 54, 56 and a lower portion 62 having a foot 93. Apertures 91, 93 extend through upper portions 60, 90 (FIG. 19) to receive screw, headed rivet, rod, pin, or comparable connection device 53 (see FIGS. 16 and 17) to couple front and rear frame members 50, 52 together. Additional details regarding upper portion 90 of rear legs 84, 86 will be discussed hereafter.

Track guides 17 of seat 14 that cooperate with guide channels 116 of frame 12 to prevent generally horizontal movement of seat 14 on frame 12 as shown in FIG. 5. While one of the two track guides 17 will be described hereafter, it is understood that the description is applicable to both track guides 17. Track guides 17 includes a plate 168 that is coupled to mounting panel 92, a generally round lower guide post 170, a stabilizing tab 172, and an elongated guide block 174. The shapes of post 170 and block 174 may vary in accordance with the present invention. Plate 168 is generally triangular in shape and includes a base edge 176 and side edges 178, 180 converging from base edge 176 toward an apex 182. As shown in FIG. 5, side edges 178, 180 intersect base edge 176 at opposite corners 184, 186. In addition, plate 168 has an outer surface 188 facing away from seat 14, an opposite inner surface 190, and an aperture 192 extending through surfaces 188, 190. In addition, a slot 194 and an aperture 196 extend through plate 168 adjacent side edge 178.

As shown in FIG. 5, guide post 170 and guide block 174 are formed for extension into guide channel 116 to steer the sliding movement of seat 14 on frame 12. Guide post 170 and guide block 174 are positioned to lie along side edge 178 of plate 168 adjacent slot 194 and aperture 196 respectively. A screw or comparable connection device 228 extends through seat 14 adjacent arm 44 and through slot 194 of guide 17 to couple guide block 174 onto inner surface 190 of plate 168 and track guides 17 to seat 14. Guide post 170 is spaced-apart from guide block 174 and lies along base edge 176 adjacent corner 184. Guide post 170 includes a post portion 230 that extends from outer surface 188 of plate 168 and a mounting portion 232 that extends from base edge 176 as shown in FIG. 2.

Mounting portion 232, as shown in FIG. 5, is movably coupled to base edge 176 by a living hinge 177. Mounting portion 232 of guide post 170 includes a back portion 234 positioned to lie adjacent plate 168, a floor portion 236, and angled side walls 238 extending between back portion 234 and floor portion 236. In addition, a non-skid bumper 240 extends through floor portion 236. Post portion 230 is fastened onto plate 168 by a screw 242 that extends through a slot 235 formed in back portion 234 of mounting portion 232 and aperture 196 into post portion 230. Screw 242 also extends through mounting panels 92 of seat 14 to couple seat 14 and track guides 17 together.

Figure 10:
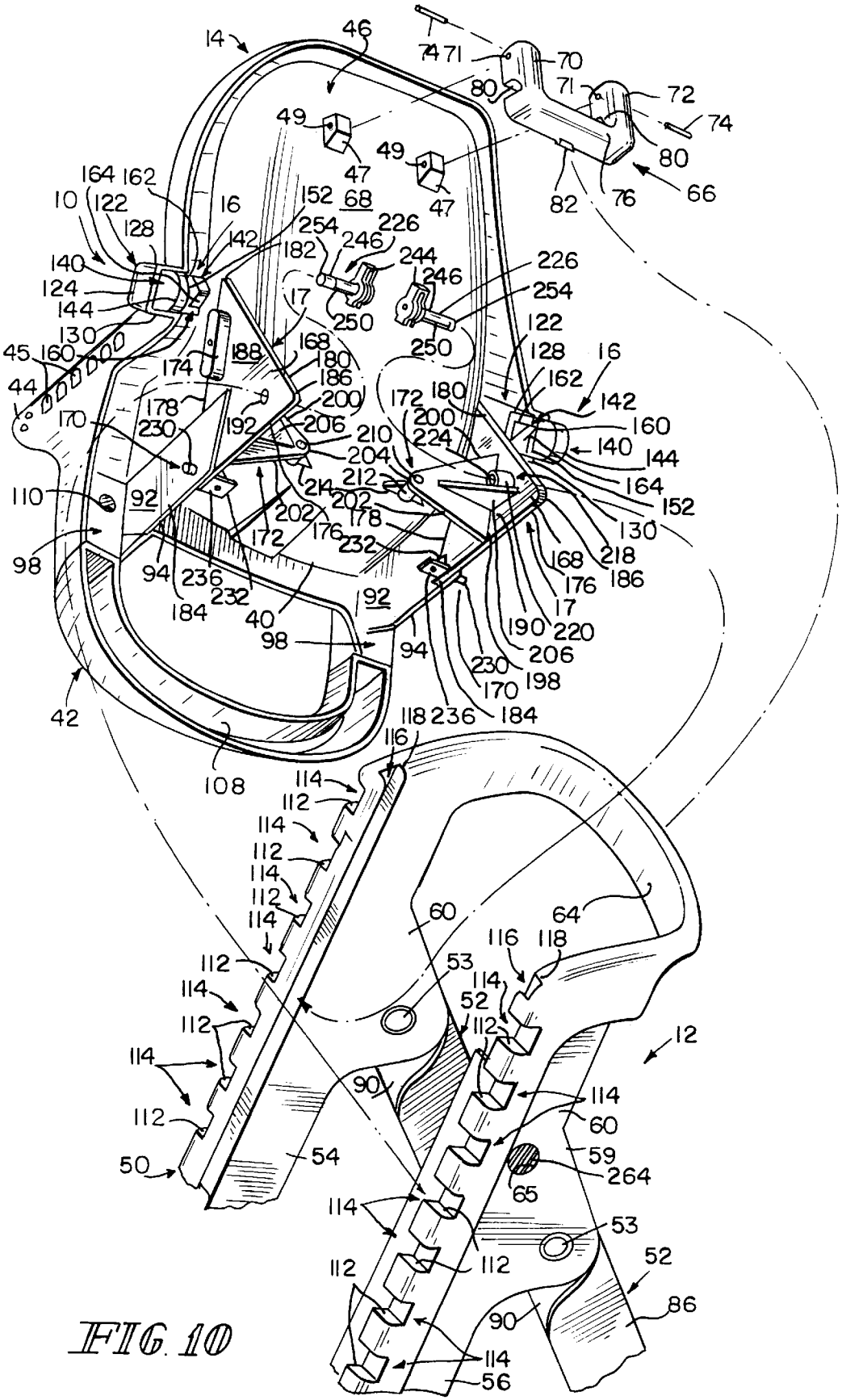
FIG. 10 is an exploded assembly view of the seat and frame of the juvenile chair of FIG. 1 showing the seat as it is poised to be situated in a reclined position on the frame and also showing a handle portion extending between the front legs of the frame and locking pins that are sized for extension through apertures formed in the track guides and into the guide channels of the front legs to prevent the seat from pivoting about the handle portion of the frame.

Stabilizing tab 172 of track guides 17 is coupled to inner surface 190 of plate 168 and is positioned to lie generally perpendicular to inner surface 190 as shown in FIG. 5. Stabilizing tab 172 includes a base portion 198 coupled to plate 168, side edges 200, 202 converging from base portion 198 toward a tab apex 204 and a support wing 206 (see FIG. 10) extending toward corner 186 as shown in FIG. 10. Stabilizing tab 172 includes an aperture 208 adjacent tab apex 204. Aperture 208 is sized to receive a screw, headed rivet, rod, pin, or comparable connection device 210 therethrough to couple stabilizing tab 172 to seat 14. Screw 210 is configured to engage a wing nut 212.

Figure 6:
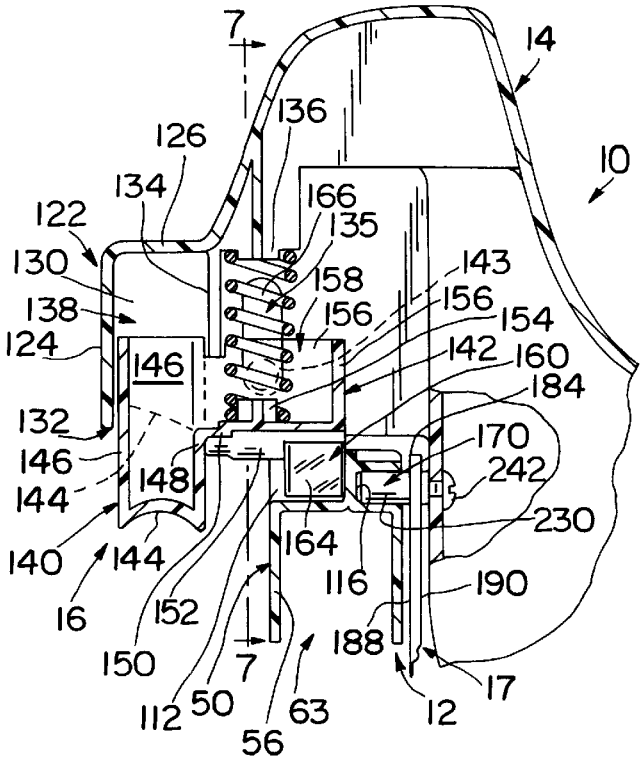
FIG. 6 is a view taken along line 6—6 of FIG. 4 showing the height-adjustment mechanism including a latch having a latch tooth extending into one of the height-position slots and the guide post extending into the guide channel.

As shown in FIGS. 5–9, height-adjustment mechanism 16 extends between seat 14 and height-position slots 114 of front legs 54, 56 to support seat 14 on frame 12 in pre-determined elevated positions. While only one height-adjustment mechanism 16 and arm 44 of seat 14 will be discussed hereafter, it is understood that the description applies to each height-adjustment mechanism 16 and to each arm 44. As best shown in FIG. 6, height-adjustment mechanism 16 is aligned with a latch cover 122 of seat 14. Latch cover 122 includes a top panel 124, an end panel 126, and opposite side panels 128, 130 (see FIG. 7) that cooperate to define an aperture 132 that is sized for extension of height-adjustment mechanism 16 therein. Latch cover 122 also includes a limit rib 134, a spring mount 136 positioned to lie adjacent limit rib 134, and a latch slot 138 that is in alignment with spring mount 136.

Height-adjustment mechanism 16 is configured to release selectively seat 14 from height-position slots 114 and enable a caregiver to lower seat 14 on frame 12 toward fully-lowered position 36. Height-adjustment mechanism 16 includes an outer latch button 140 sized for sliding movement within aperture 132 of the latch cover 122 and an inner latch 142. Outer latch button 140 is shown in FIG. 5 and includes a hand-gripping end 144, outer side walls 146 extending from end 144, and an inner partial wall 148 extending from end 144. Outer side walls 146 extend into aperture 132 and prevent generally horizontal movement of outer latch button 140 relative to latch cover 122.

Referring now to FIG. 6, height-adjustment mechanism 16 also includes a restriction segment 150 that extends between outer latch button 140 and inner latch 142. Segment 150 selectively engages limit rib 134 of latch cover 122 to limit movement of outer latch button 140 into latch slot 138 during sliding movement of seat 14 upon frame 12. Inner latch 142 includes an end wall 152 having a spring mount 154 and side walls 156 extending from end wall 154 to define a spring-receiving cavity 158 therein. Spaced- apart tabs 143 are coupled to side walls 156 and extend through limit slots 135 to couple inner latch 142 to latch cover 122. Tabs 143 and slots 153 cooperate to guide movement of height-adjustment mechanism within latch cover 122. As shown in FIG. 6, a spring 166 extends through cavity 158 between spring mount 136 of latch cover 122 and spring mount 154 of inner latch 142. Spring 166 biases inner latch 142 away from seat 14.

Figure 7:
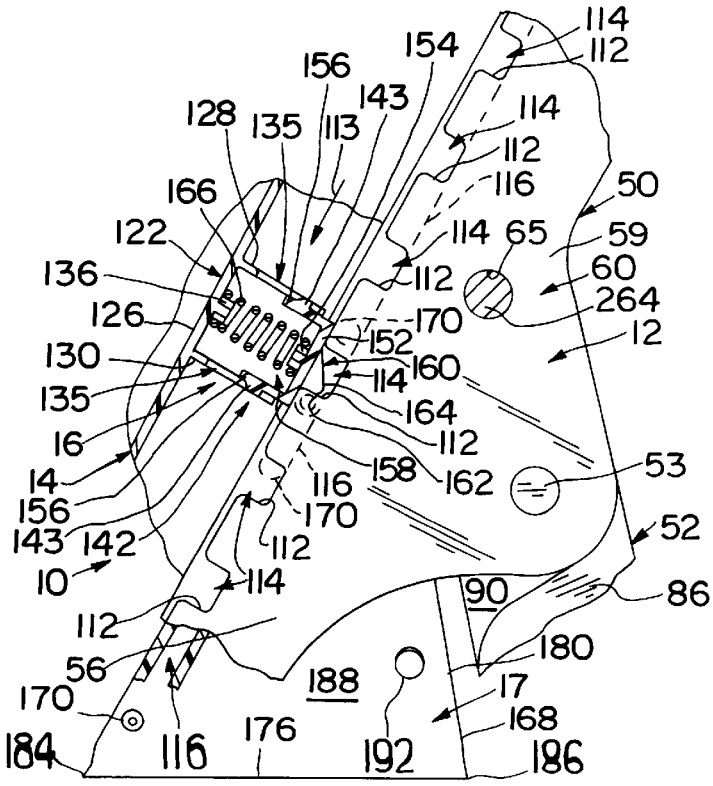
FIG. 7 is a view taken along line 7—7 of FIG. 6 showing the latch tooth including a flat surface engaging one of the height-position slots to block vertically downward movement of the guide post in the guide channel and showing the guide channel positioned to lie adjacent the height-position slots in the front leg.
Figure 8:
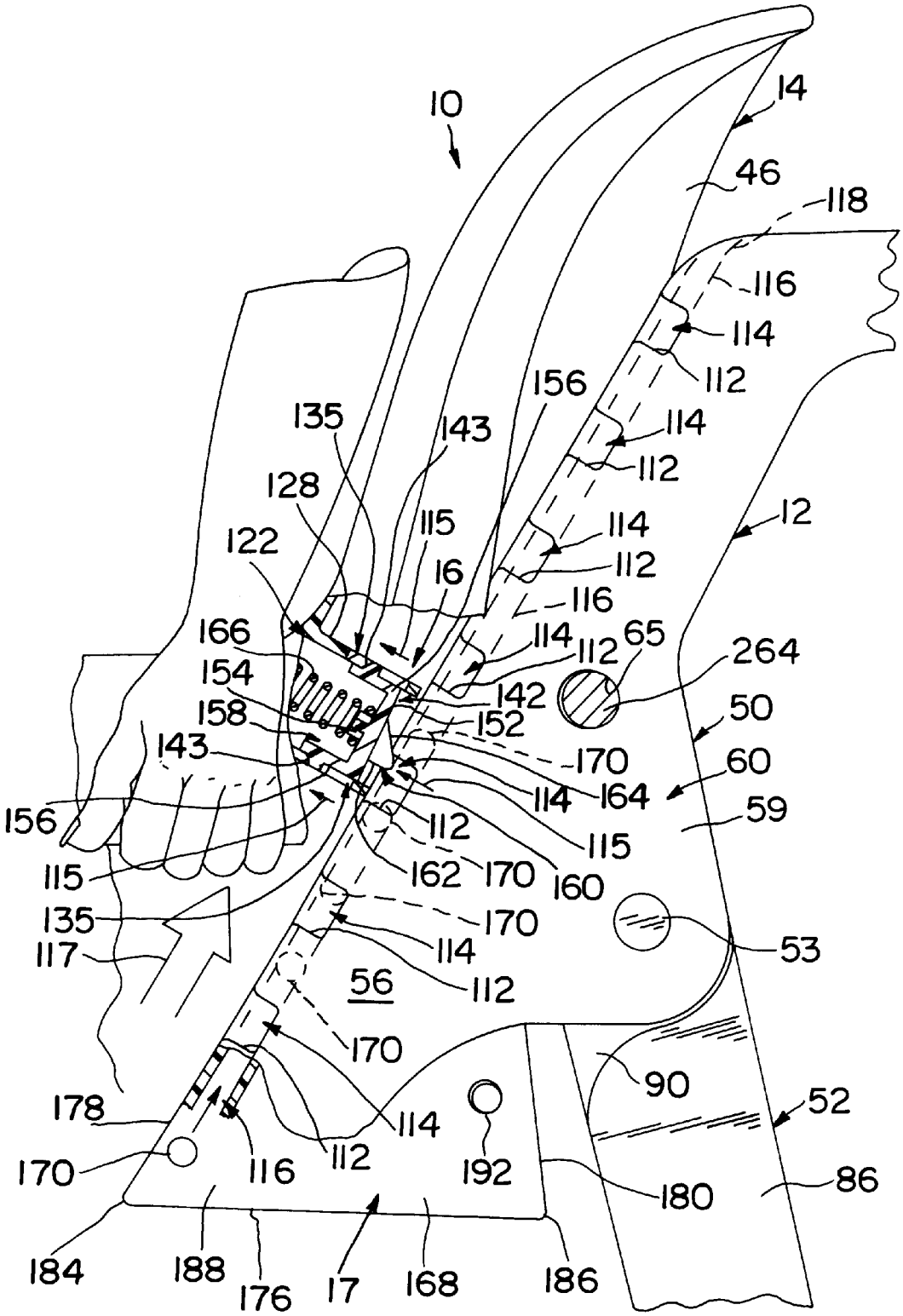
FIG. 8 is a view similar to FIG. 7 showing the latch tooth cam surface engaging one of the height-position slots to permit ramping vertically upward movement of the guide post in the guide channel thus moving the seat to a higher elevation.
Figure 9:
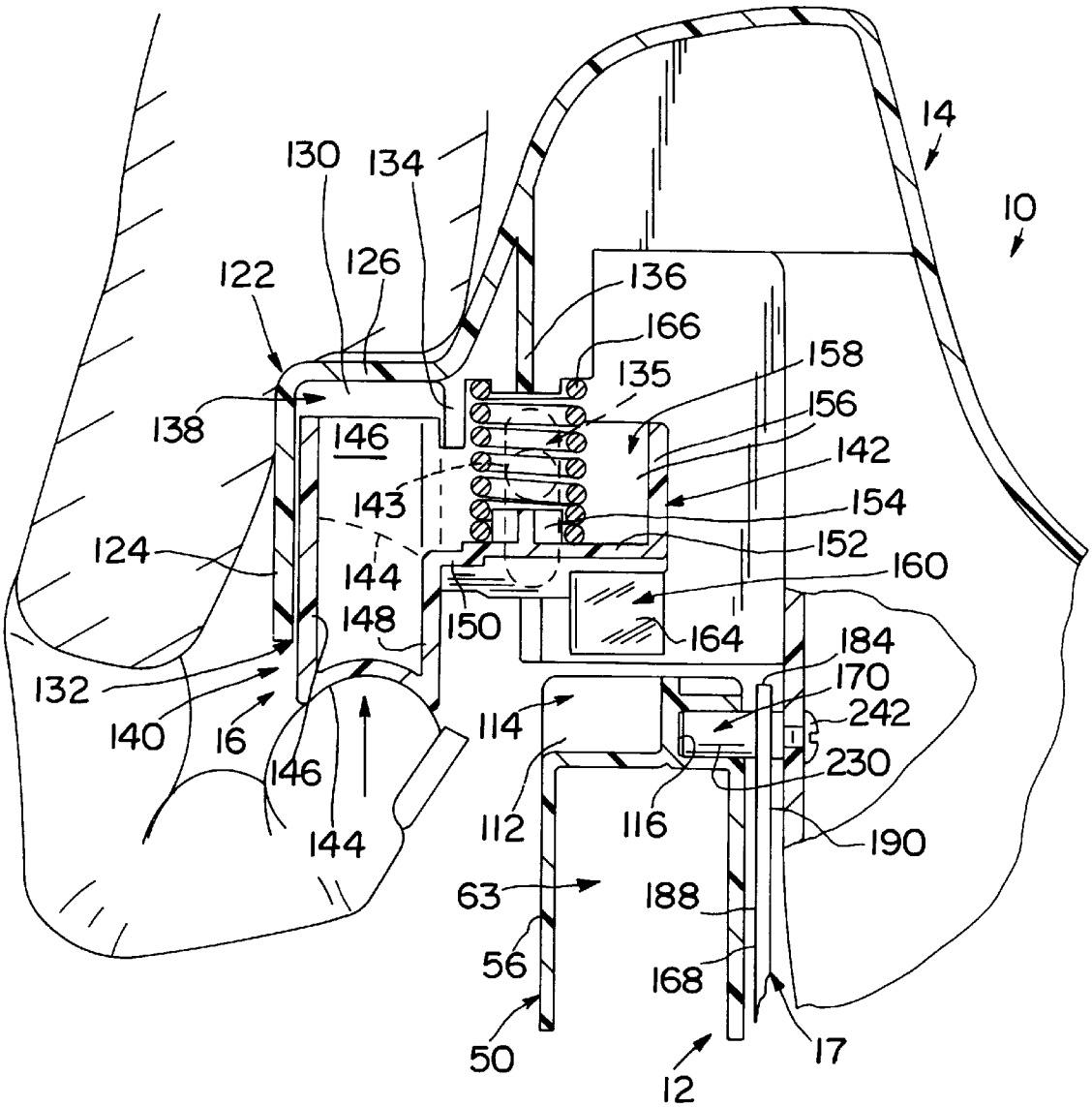
FIG. 9 is a view similar to FIG. 6 showing manual compression of a latch button of the height-adjustment mechanism to pull the latch tooth out from the height-position slot and enable the guide post to slide freely within the guide channel of the front leg so that the seat is movable between the fully-elevated position and the fully-lowered position.

Referring now to FIGS. 5 and 6, inner latch 142 also includes a latch tooth 160 that extends from end wall 152 away from spring mount 154 and that is sized to fit into slot 114. Latch tooth 160 includes a cam surface 164 to permit ramping upward movement to a higher elevation without the user moving outer latch button 140. Latch tooth 160 also includes a generally flat locking surface 162 extending from end wall 152 facing in an opposite direction from cam surface 164 to block downward movement of seat 14 on frame 12 unless both spring biased latches 142 are simultaneously manually activated. So, as shown in FIG. 7, flat surface 162 of latch tooth 160 engages locking surface 112 of height-position slot 114 when seat 14 is mounted on frame 12 blocking generally vertically downward movement, as shown by arrow 113, of seat 14 on frame 12. Cam surface 164 as shown in FIG. 8, is configured to bias yieldably height-adjustment mechanism 16 out from height-position slot 114, as shown by arrows 115, when latch tooth 160 is lifted into engagement with locking surface 112, as shown by arrow 117, toward fully-elevated position 38. Latch tooth 160 therefore selectively prevents seat 14 from sliding generally vertically downwardly on front legs 54, 56 toward foot portions 48 while permitting seat 14 to be ramped in a generally vertically upwardly direction 115 away from foot portions 48.

Figure 11:
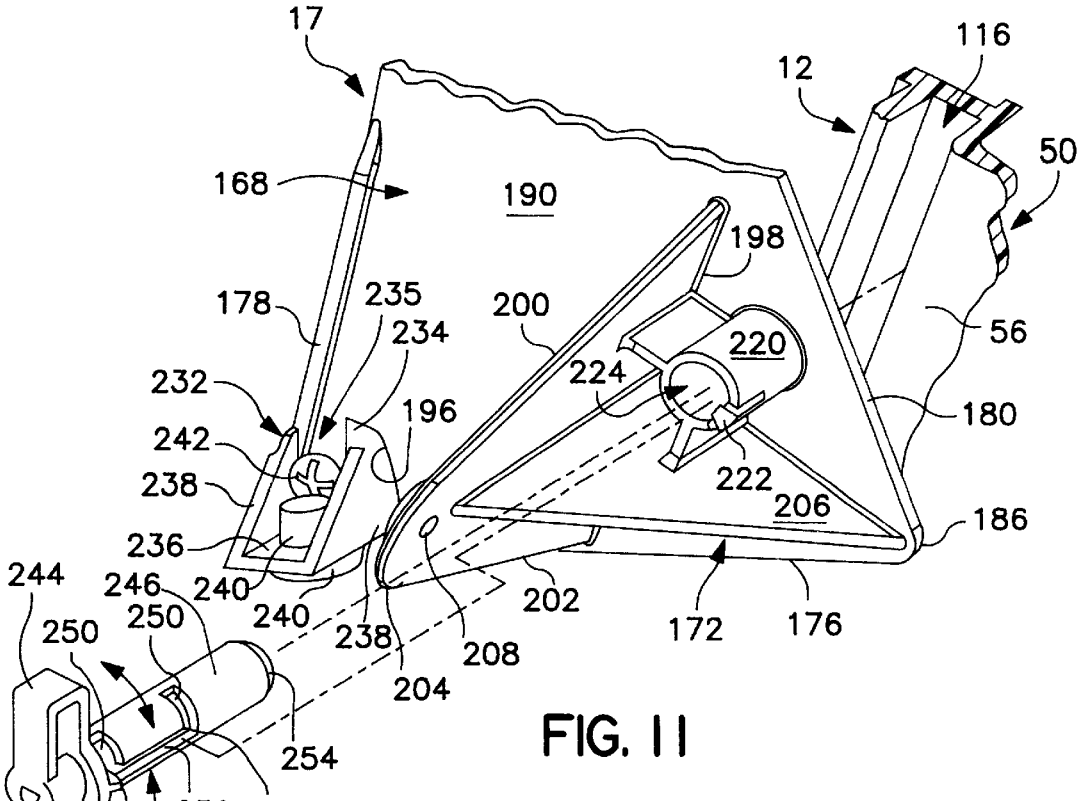
FIG. 11 is an enlarged perspective view of one track guide and one guide channel showing the track guide including a sleeve and the locking pin including a weighted handle and a shaft that is configured for extension through the sleeve and into the guide channel of the front leg to fix the seat in the reclined position.
Figure 12:
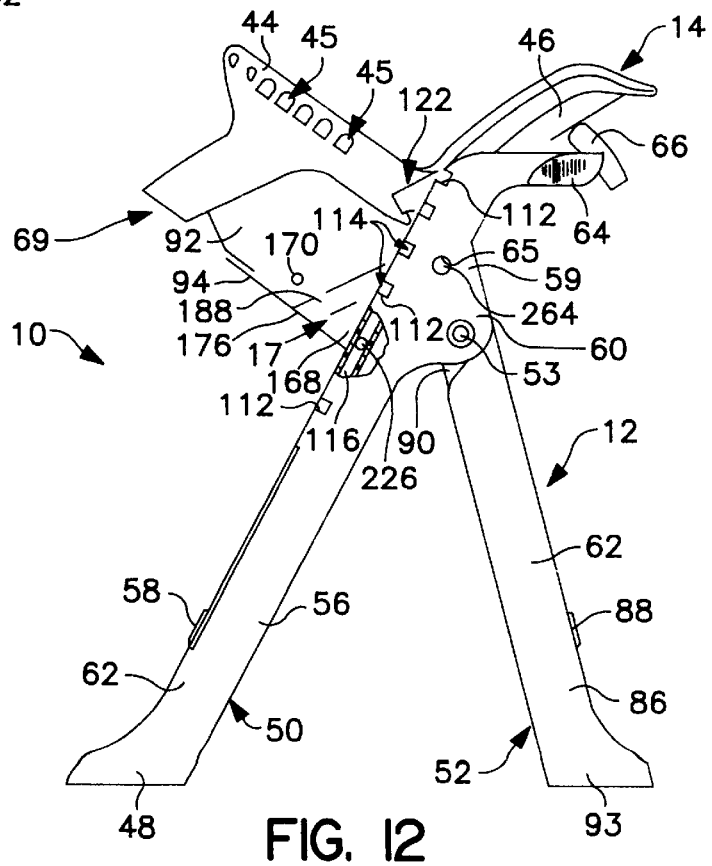
FIG. 12 is a side view of the juvenile chair of FIG. 10 in the reclined position showing a handle of the seat in engagement with the handle portion of the frame and the locking pin positioned within the guide channel to prevent pivoting movement of the seat relative about the handle portion.

As shown in FIGS. 10–12, seat 14 may also be mounted on frame 12 in a reclined position 69 when guide post 170 and guide block 174 of plate 168 have been removed from guide channel 116. To mount seat 14 in reclined position 69, seat back 46 of seat 14 is formed to include a handle 66 that engages frame 12. As shown in FIG. 10, handle 66 is coupled to mounting tabs 47 on seat back 46 by pivot pins 74 that extend into apertures 71 formed in opposite end portions 70, 72 of handle 66 and through apertures 49 formed in mounting tabs 47.

Handle 66 is free to pivot relative to seat back 46 on pivot pins 74. Handle 66 has opposite end portions 70, 72 and a shaft portion that extends between opposite end portions 70, 72. End portions 70, 72 are positioned to lie in a spaced-apart relationship relative to one another so that a hand-receiving space 78 is formed therebetween. In addition, end portions 70, 72 of handle 66 are formed to include notches 80 therein adjacent shaft portion 76. Thus, handle 66 may extend over handle portion 64 so that notches 80 engage handle portion 64 and fix handle 66 on handle portion 64 of frame 12.

Figure 13:
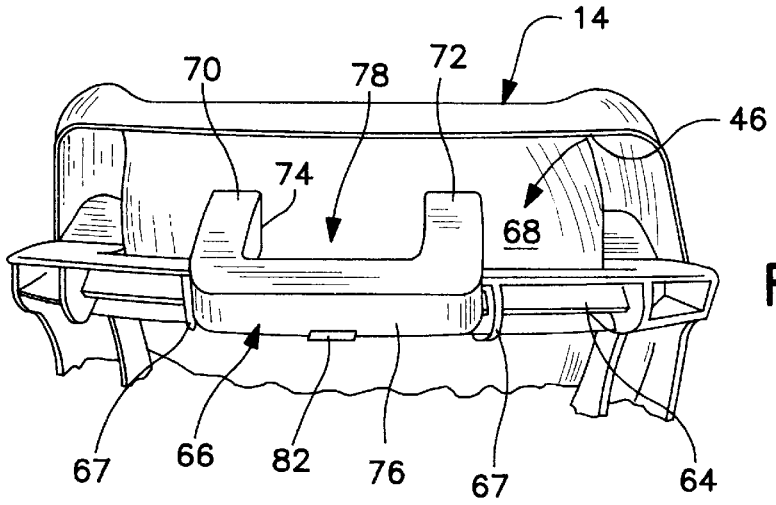
FIG. 13 is an enlarged rear view of the juvenile chair of FIG. 12 showing the handle of the seat coupled to the handle portion of the frame when the seat is in the reclined position.

Shaft portion 76 of handle 66, as shown in FIG. 10, also includes a catch 82 to hold selectively shaft portion 76 against seat back 46 of seat 14. As shown in FIG. 13, handle portion 64 of frame 12 includes blocking tabs 67 spaced apart thereon. Tabs 67 block generally horizontal sliding movement of handle 66 on handle portion 64 when seat 14 is mounted in reclined position 69. Handle 66 may be formed in a variety of shapes and that handle 66 may be coupled to seat back 46 using a variety of connection devices such as screws, pivots, posts, pins, tabs, or the like in accordance with the present invention.

Referring now to FIG. 10, guides 17 of seat 14 include locking pins 226 that cooperate with guide channels 116 of frame 12 to block pivoting movement of seat 14 on frame 12 when in reclined position 69. While only one guide 17 and guide channel 116 will be discussed, the description applies to both guides 17 and channels 116. As shown in FIG. 11, guide includes a sleeve 220 that is aligned with aperture 192 of plate 168 and is coupled to stabilizing tab 172 and inner surface 190 of plate 168. Sleeve 220 has a flexible tab portion 222 and defines a guide-slot channel 224 that is in alignment with aperture 192 and sized to receive a locking pin 226 therethrough.

As shown in FIG. 11, locking pin 226 of guide 17 is sized for extension through guide-slot channel 224 and into guide channel 116 to support seat 14 in reclined position 69. Locking pin 226 includes a weighted handle 244 and a shaft 246 sized for extension through guide-slot channel 224. Shaft 246 includes a distal end 254 and a passage 248 extending between handle 244 and distal end 254 with a radially extended portions 250 at distal ends 252 thereof Passage 248 is sized for extension of flexible tab portion 222 of sleeve 220 therein to provide a two position displacement of locking pin 226 and to retain locking pin 226 within aperture 192. One position of locking pin 226 has distal end 254 positioned to lie within guide channel 116 to support seat 14 and prevent pivoting movement of seat 14 relative to frame 12. Second position of locking pin 226 has distal end 254 extending out from guide channel 116 to permit movement of seat 14 on frame 12 from reclined position 69. Thus, seat 14 may be moved easily between the reclined position 69 (FIG. 12) and upright positions 36, 38 as shown in FIGS. 1–4.

Figure 14:
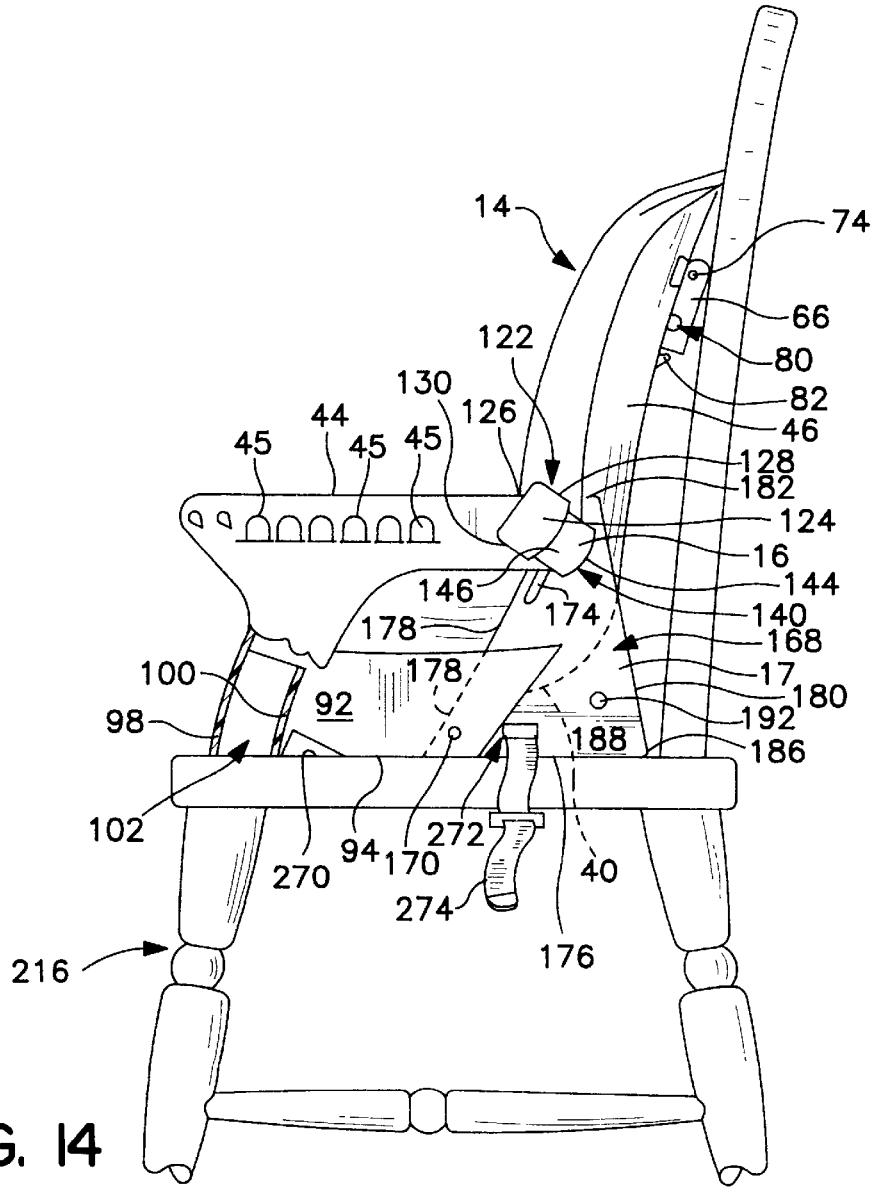
FIG. 14 is a side view of the seat of FIG. 1 positioned to lie upon a stationary chair showing a flexible belt extending through an aperture in the track guide and about a seat bottom of the stationary chair to hold the seat upon the stationary chair.

As shown in FIG. 14, seat 14 is also mountable upon a generally flat surface such as a seat bottom 270 of stationary chair 216 to serve as a booster seat and extend the useful life of juvenile chair 10 once the child's legs have grown past foot rest 42. To use seat 14 as a booster seat, seat 14 must first be removed from frame 12 and detached from foot rest 42. Track guides 17 include an aperture 272 therethrough that is sized to receive a flexible belt 274. Flexible belt 274 extends through aperture 272 in each track guides 17 and about seat bottom 270 to secure seat 14 upon stationary chair 216. Referring now to FIG. 5, stabilizing tab 172 of each guide 17 also cooperates with mounting panels 92 and plates 168 to support seat 14 upon seat bottom 270.

Further, frame 12 of juvenile chair 10 is movable between expanded position 280 and a folded position 282 as shown in FIGS. 15, 18 and 20, 23 by operating latches 288, 290, respectively, for folding and unfolding frame member 50 relative to frame member 52. Although a wide variety of latches can be used to permit frame 12 to move between the expanded and folded positions 280, 282, latches 288, 290 shown in FIGS. 15–18 and 19–23, respectively, are preferable. In addition, although only legs 56 and 86 of frame will be discussed hereafter, it is understood that the description applies to legs 54 and 84 as well.

Figure 15:
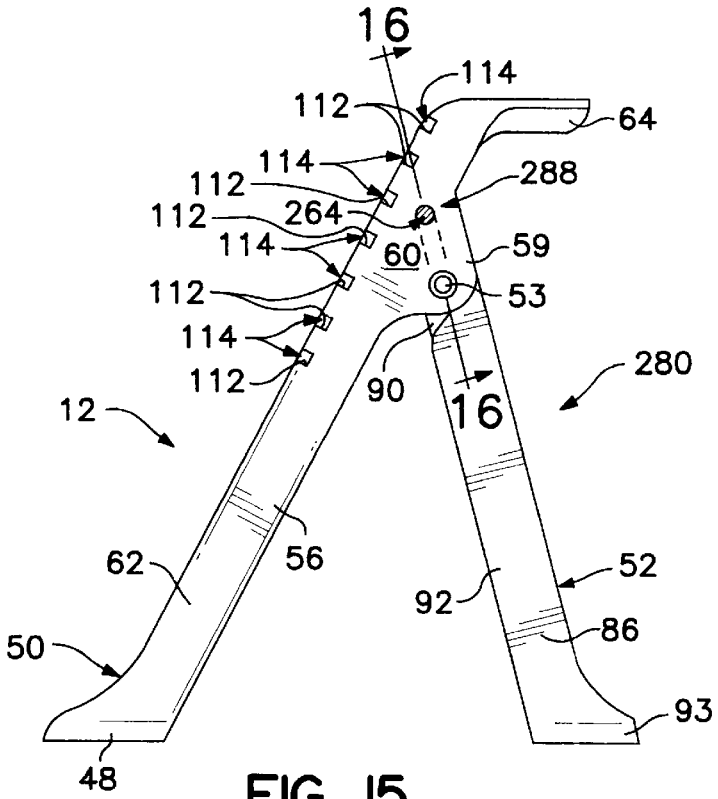
FIG. 15 is a side view of the frame of FIG. 1 showing the frame including a pivot post extending through the front and rear legs and a first embodiment of a releasable latch that latches the front and rear legs in an expanded position.
Figure 16:
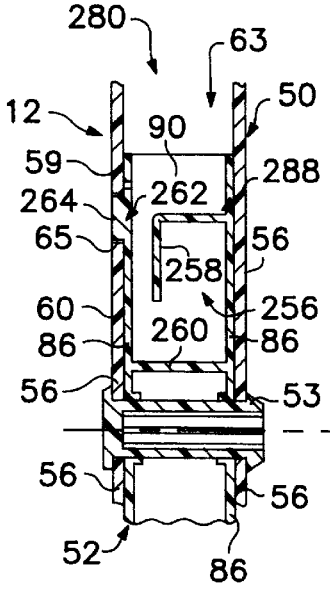
FIG. 16 is a view taken along line 16—16 of FIG. 15 showing the rear leg of the frame including flexible tab extending through an aperture formed in the front leg to define the releasable latch that locks the front and rear legs in the expanded position.
Figure 17:
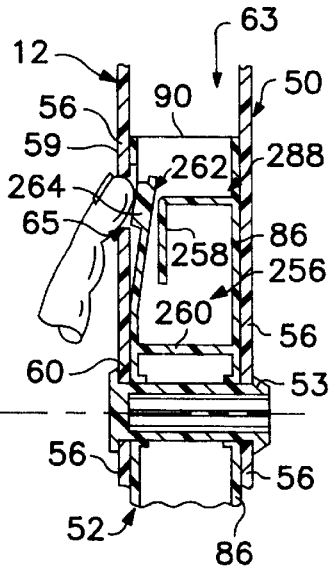
FIG. 17 is a view similar to FIG. 16 showing a manual compression of the flexible tab of the rear leg through the aperture formed in the front leg to permit the latch to be released such that the front and rear legs of the frame can pivot relative to one another on the pivot post.
Figure 18:
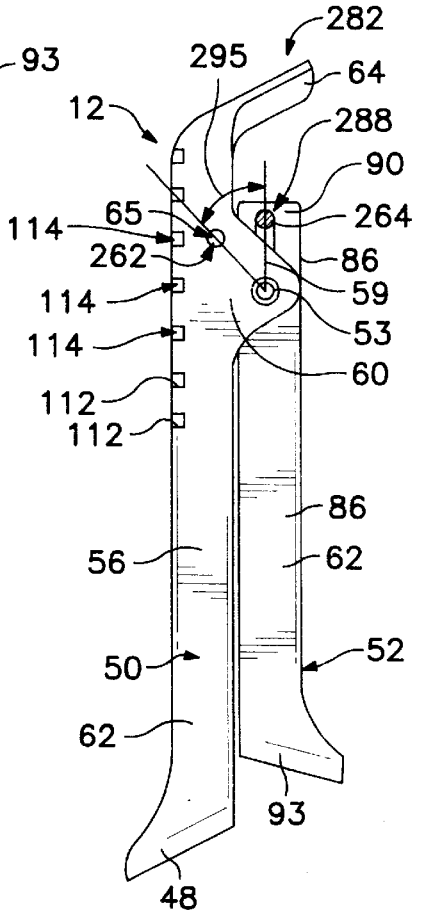
FIG. 18 is a view similar to FIG. 15 showing the flexible tab of the rear leg spaced-apart from the aperture of the front leg and showing the front and rear legs positioned to lie in a folded position.

As shown in FIGS. 16 and 17, leg 86 of rear frame member 52 is formed to define a cavity 256 adjacent upper portion 90 that houses a limit rib 258. In addition, leg 86 includes a support 260 that extends through cavity 256 spaced apart from limit rib 258. Support 260 is coupled to latch 288, which includes a flexible tab member 262. Tab member 262 forms a portion of second leg 86 and includes a radially outwardly extending tab 264. Tab 264 is positioned to lie adjacent limit rib 258 and is sized for selective extension through aperture 65 and engagement with leg 56 to couple legs 56, 86 together when frame 12 is in expanded position 280 as shown in FIG. 15. When frame 12 is in folded position 282, as shown in FIG. 18, tab 264 is spaced apart from aperture 65 at a pre-determined angles 295 permitting legs 56, 86 to pivot relative to one another. Placement of aperture 65 in upper portion 60 sets an angle that legs 56, 86 may pivot relative to one another.

Frame 12 is movable between expanded position 280 of FIG. 15 and folded position 282 of FIG. 18 by disengaging tab 264 (i.e., latch 288) from leg 56. As best shown in FIG. 17, flexible tab 264 is pressed into cavity 256 against limit rib 258 so that tab 264 is positioned outside of aperture 65. At this time, legs 56, 86 are free to pivot relative to one another on pivot post 53. Thus, tab 264 acts as a latch to allow frame 12 to move between the expanded and folded positions 280, 282. As shown in FIG. 18, legs 56, 86 are configured to pivot a pre-determined distance relative to one another.

Figure 19:
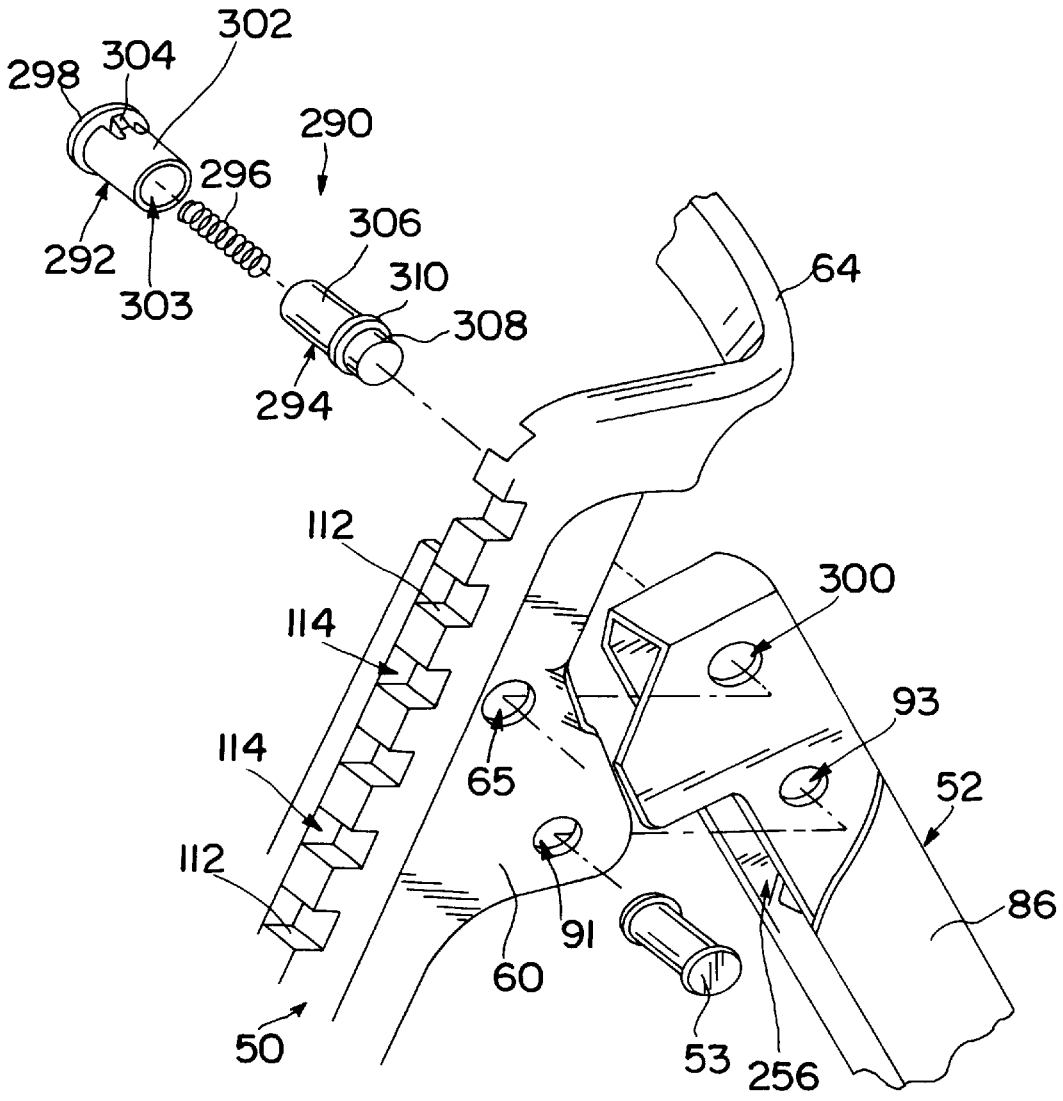
FIG. 19 is an exploded perspective view of a frame similar to the frame of FIG. 1 showing a second embodiment of a releasable latch that allows the front and rear legs of the frame to pivot relative to one another on a pivot post, the latch including a base, a bolt, and a spring that biases the bolt away from the base when the latch is positioned within a channel formed in the rear leg.
Figure 20:
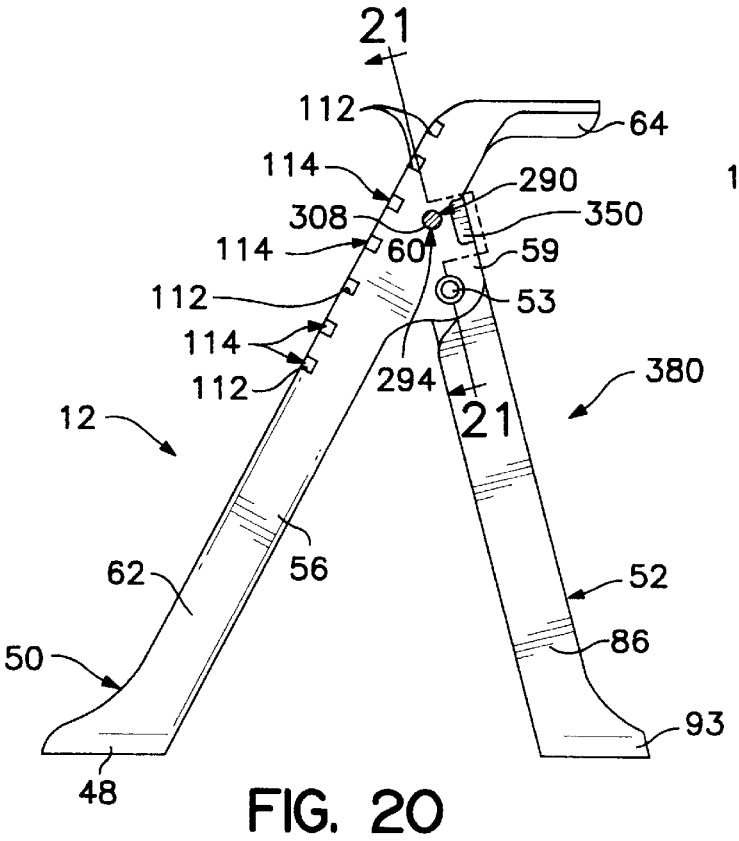
FIG. 20 is a side view of the frame of FIG. 19 showing the pivot post extending through the front and rear legs and the bolt of the latch extending through the front and rear legs to latch the front and rear legs in an expanded position.
Figure 23:
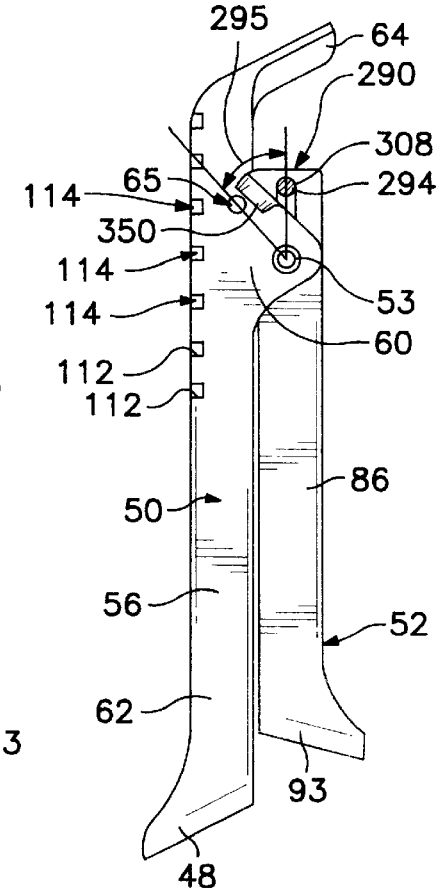
FIG. 23 is a view similar to FIG. 20 showing the button member spaced-apart from the aperture of the front leg and showing the front and rear legs positioned to lie in the folded position.
Figure 21:
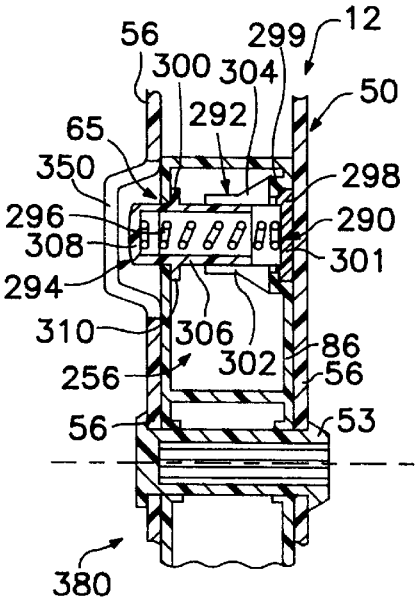
FIG. 21 is a view taken along line 21—21 of FIG. 20 showing a button member of the bolt extending through an aperture formed in the front and rear legs to latch the front and rear legs in the expanded position.
Figure 22:
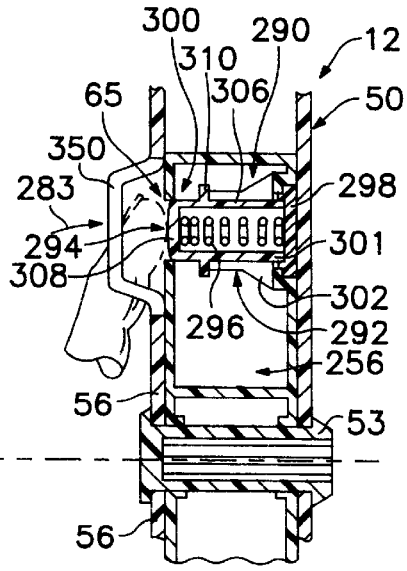
FIG. 22 is a view similar to FIG. 21 showing manual compression of the button member of the bolt through the aperture formed in the front leg to permit the latch to be released such that the front and rear legs of the frame can pivot relative to one another on the pivot post.
Figure 24:
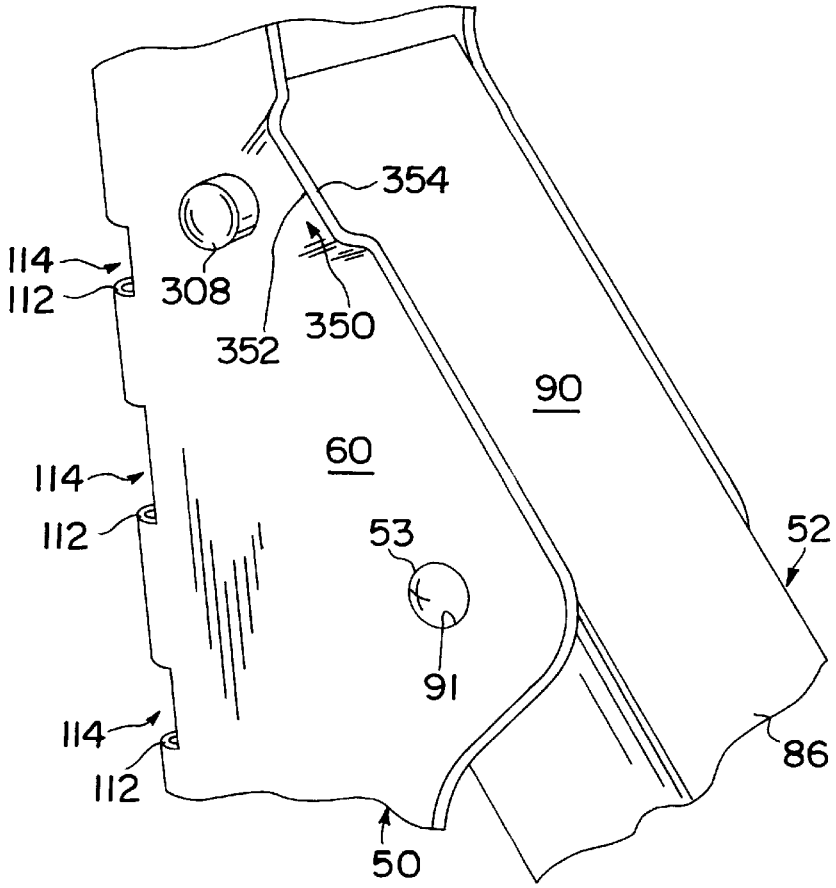
FIG. 24 is a enlarged view of the frame of FIG. 19 in the expanded position showing the front leg including a ramp portion positioned to lie adjacent to the button member extending through the aperture.

A second embodiment of latch 290 is shown in FIGS. 19–26. Latch 290 enables a caregiver to move frame members 50, 52 between expanded position 280 and a folded position 282 as shown in FIGS. 20 and 23 by operating latches 290. Latch 290 also cooperates with a ramped portion 350 of upper portion 60 to enable the caregiver to unfold frame members 50, 52 by simply pulling foot portions 48, 93 away from one another until frame is in expanded position 380. Ramped portion 350 includes an outer surface 352 and an opposite tapered inner surface 354. As shown in FIG. 19, latch 290 includes a base 292, a bolt 294, and a spring 296 that biases bolt 294 away from base 292. Referring now to FIGS. 21 and 22, base 292 is configured to extend through a first hole 300 formed in rear leg 86 into cavity 256. Base 292 includes a mount 298 and a guide sleeve 302 that extends from mount 298, defines a cavity 303, and is formed to include a flexible lock member 304. As shown in FIG. 19, lock member 304 of base 292 cooperates with mount 298 to sandwich rear leg 86 therebetween and therefore lock base 292 in a predetermined position within hole 300.

Bolt 294 is configured to be in reciprocating engagement with base 292. Bolt 294 includes a guide post 306 that extends into cavity 303 of guide sleeve 302. Bolt 294 also includes a button member 308 that extends through hole 300 formed in rear leg 86. Button member 308 also selectively extends through aperture 65 formed in front frame member 50, as shown in FIG. 21, when frame 12 is in the expanded position 380. Additionally, bolt 294 includes a stop ring 310 interconnecting guide post 306 and button member 308. Stop ring 310 limits movement of guide post 306 through aperture 65 and into guide sleeve 302. Spring 296 extends into guide sleeve 302 when base 292 is positioned in hole 300 within cavity 256. Bolt 294 is then positioned to be in sliding engagement with base 292 with spring 296 biasing bolt 294 away from base 292.

Frame 12 is movable between expanded position 380 of FIG. 20 and folded position 382 of FIG. 23 by disengaging latch 290. When frame 12 is in the expanded position 380, latch 290 is in an engaged position as shown in FIG. 21. In the engaged position, base 292 is mounted to leg 86 by having mount 298 positioned in a recess 299 of rear leg 86 with guide sleeve 302 extending from mount 298 through hole 301 into cavity 256. In addition, in the engaged position, guide post 306 of bolt 204 extends into guide sleeve 302 of base 292 so that button member 308 of bolt 294 extends through hole/aperture 300, 65 of legs 86, 56, respectively, to lock frame 12 in expanded position 380. To move from expanded position 380 to folded position 382, latch 290 is disengaged, as shown in FIG. 22 by having a user press inwardly on button member 308 as shown by arrow 283. When button member 308 is pressed, spring 296 compresses and bolt 294 slides into guide sleeve 302 of base 292 so that button member 308 no longer extends through aperture 65 of leg 56. In this disengaged position, legs 56, 86 are free to pivot relative to one another on pivot post 53 towards the folded position 382 shown in FIG. 23.

Figure 25:
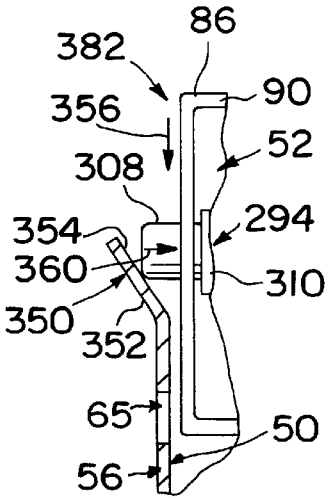
FIG. 25 is a side view of the frame of FIG. 19 with portions broken away showing the frame moving from the folded position to the expanded position and showing the ramp portion of the front leg pressing the button member through the aperture formed in the back leg.
Figure 26:
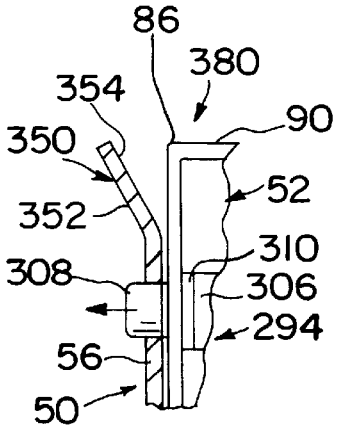
FIG. 26 is a view similar to FIG. 25 showing extension of the button member through the aperture in the front leg when the frame has reached the expanded position.

Referring now to FIGS. 25 and 26, frame members 50, 52 are movable from folded position 382 to expanded position 380. When in folded position 382 frame members 50, 52 are movable relative to one another as shown by arrow 356 in FIG. 25. Movement 356 causes button portion 308 to engage inner surface 354 of ramped portion 350. Inner surface 356 guides, as shown by arrow 360, button portion 308 into hole 300 of leg 86 and thus into cavity 303 of guide sleeve 302. Once leg 56 has passed over leg 86 and aperture 65 is aligned with button member 308, button member is biased by sprig 296 through aperture 65. At this time, frame members 50, 52 are locked in expanded position 380. Thus, ramped portion 350 makes it unnecessary for a caregiver to manually depress button member 308 to unfold frame members 50, 52.

To mount seat 14 upon frame 12 in fully-elevated position 38, the caregiver must simply place guide post 170 and elongated guide block 174 into first end 118 of guide channel 116 and press seat 14 toward lower portion 62 of legs 54, 56. Height-adjustment mechanism 16 will snap into and engage a highest of seven height-position slots 114 formed in front legs 54, 56. To lower seat 14 upon frame 12 toward fully-lowered position 36, the caregiver must compress height-adjustment mechanisms 16 simultaneously and slide seat 14 toward lower portion 62 of legs 54, 56. To return seat 14 to fully-elevated position 38, the caregiver must only lift seat 14 toward fully-elevated position 38. Height-adjustment mechanisms 16 are yieldably biased away from slots 114 permitting track guides 17 of seat 14 to slide upwardly in guide channel 116 toward first end 118.

To mount seat 14 upon frame 12 in reclined position 69, the caregiver first removes track guides 17 from guide channels 116. Handle 66 on seat back 46 of seat 14 is then placed over handle portion 64 of frame 12 so that handle portion 64 engages notches 80. Locking pins 226 are also moved within sleeves 220 until distal end 254 of shaft 246 extends into guide channel 116. Weighted handle 244 is rotated to lock locking pin 226 within guide channel 116. Thus, locking pins 226 act to support seat 14 on frame 12 and prevent pivoting movement of seat 14 relative to frame 12.

Although the invention has been described in detail with reference to preferred embodiments, variations and modifications exist within the scope and spirit of the invention as described and defined in the following claims.

What is claimed is:

1. A juvenile chair comprising a frame formed to include an upper portion, a lower portion, a first guide channel extending between the upper and lower portions, and height-position slots positioned to lie spaced apart from the first guide channel, a seat including a first track guide sliding in the first guide channel, and a latch movably coupled to the seat and selectively engaging at least one of the height-position slots of the frame when the track guide extends into the first guide channel to block sliding movement of the seat toward the lower portion of the frame.

2. The juvenile chair of claim 1, wherein the frame includes first and second front legs and the height-position slots are positioned to lie in a spaced-apart relationship in the first and second front legs.

3. The juvenile chair of claim 2, wherein the first and second front legs each include seven height-position slots.

4. The juvenile chair of claim 2, further comprising a spring extending between the latch and the seat and the spring yieldably permits movement of the latch toward the seat away from the height-position slots in response to sliding movement of the first track guide in the first guide channel toward the upper portion of the frame.

5. The juvenile chair of claim 4, wherein the first front leg is formed to include the first guide channel, the second front leg is formed to include a second guide channel and the seat includes a second track guide spaced apart from the first track guide and configured for sliding movement within the second guide channel.

6. The juvenile chair of claim 2, wherein the first front leg is formed to include the first guide channel, the second front leg is formed to include a second guide channel, and the seat includes a second track guide spaced apart from the first track guide and configured for sliding movement within the second guide channel.

7. The juvenile chair of claim 6, wherein the first and second track guides each include a plate coupled to the seat and a guide post extending outwardly from the plate and the guide post is sized for sliding movement in the respective first and second guide channels of the frame.

8. The juvenile chair of claim 7, wherein the first and second track guides each further include a guide block spaced-apart from the guide post and the guide block is sized for sliding movement in the respective first and second guide channels of the frame.

9. The juvenile chair of claim 2, wherein the frame includes a handle portion extending between the first and second front legs, the seat includes a seat bottom and a seat back extending from the seat bottom and a handle mounted on the seat back, and the handle engages the handle portion when the seat is mounted on the frame in a reclined position.

10. The juvenile chair of claim 9, wherein the handle is formed to include notches sized to receive at least a portion of the handle portion of the frame therein when the seat is in the reclined position.

11. The juvenile chair of claim 10, wherein the first track guide includes a plate having an aperture therethrough and a locking pin extending through the aperture into the first guide channel of the frame when the seat is in the reclined position.

12. The juvenile chair of claim 11, wherein the first track guide further includes a sleeve that extends about the aperture and is sized to receive the locking pin and the sleeve includes a flexible tab configured to engage the locking pin.

13. The juvenile chair of claim 12, wherein the locking pin includes a handle and a shaft extending from the handle and including a passage sized for extension of the flexible tab therein to couple the locking pin within the sleeve.

14. The juvenile chair of claim 1, further comprising a spring extending between the latch and the seat and the spring yieldably permits movement of the latch toward the seat away from the height-position slots in response to sliding movement of the first track guide in the first guide channel toward the upper portion of the frame.

15. The juvenile chair of claim 14, wherein the latch includes an outer latch button configured for movement toward the seat to pull the latch away from the height-position slots and permit the first track guide to slide in the first guide channel toward the lower portion of the frame.

16. The juvenile chair of claim 1, wherein the frame includes rear legs and front legs pivotally coupled to the rear legs so that the frame is movable between an expanded position and a folded position.

17. The juvenile chair of claim 16, wherein the front legs are formed to include an aperture therethrough and the rear legs include a flexible tab member sized for selective extension through the aperture and engagement with the front legs to couple the front and rear legs together when the frame is in the expanded position.

18. The juvenile chair of claim 16, further comprising frame latches, wherein the front legs are formed to include an aperture therethrough and the rear legs are formed to include a pair of opposing holes therethrough, the frame latches are sized for selective extension through the holes and the aperture and engagement with the front legs to couple the front and rear legs together when the frame is in the expanded position.

19. The juvenile chair of claim 18, wherein the front legs are formed to include a ramped portion positioned to guide movement of each frame latch into the respective hole of the rear leg during movement from the folded position to the expanded position.

20. A juvenile chair comprising a frame including guide channels, a seat formed to include guide posts adapted for movement within the guide channels, and means for adjusting the elevation of the seat relative to the frame, the adjusting means being separated from the guide channels.

21. The juvenile chair of claim 20, wherein the adjusting means includes height-position slots formed in the frame and a latch coupled to the seat.

22. The juvenile chair of claim 21, wherein the frame includes front legs and the height-position slots are positioned to lie in a spaced-apart relationship in the front legs.

23. The juvenile chair of claim 21, further comprising a spring, wherein the latch includes a latch tooth normally biased away from the seat by the spring into engagement with at least one of the height-position slots.

24. The juvenile chair of claim 23, wherein the latch tooth includes a cam surface configured to move the latch toward the seat in response to engaging the cam surface and height-position slot so that the seat may slide on the frame to a greater elevation.

25. A juvenile chair adapted for placement on a surface, the juvenile chair comprising a frame including an upper portion and a lower portion adapted to engage the surface, a guide channel extending between the upper and lower portions, and height-position slots positioned to lie spaced apart from the guide channel, a seat including a track guide formed for sliding movement within the guide channel of the frame, a movable latch coupled to the seat for mounting the seat on the frame, the latch being configured for selective engagement of the height-position slots to mount the seat on the frame in a fixed pre-determined vertical position relative to the lower portion, and an outer latch button coupled to the latch to disengage the latch from the locking surfaces so that the seat is released from the fixed pre-determined position and slides between a fully-lowered position and a fully-elevated-position on the frame.

26. The juvenile chair of claim 25, wherein the track guide includes a plate extending from the seat and a guide post extending outwardly from the plate and the guide post is sized for sliding movement in the guide channel of the frame.

27. The juvenile chair of claim 25, wherein the seat includes a seat back having a handle and the handle is configured to engage the frame when the seat is in a reclined position.

28. The juvenile chair of claim 27, wherein the track guide includes a plate with an aperture and a locking pin that extends through the aperture and extends into the guide channel when the seat is in the reclined position.

29. The juvenile chair of claim 25, wherein the latch includes a cam surface configured to move the latch toward the seat in response to sliding movement of the track guide in the guide channel toward the upper portion of the frame.

30. A juvenile chair comprising a frame including guide channels, a seat formed to include guide posts adapted for movement within the guide channels, and means for adjusting the elevation of the seat relative to the frame, the adjusting means being separate from the guide channels, the seat including a seat back having a handle configured to engage the frame when the seat is in a reclined position.

31. The juvenile chair of claim 30, wherein the guide post is coupled to the plate.

32. The juvenile chair of claim 30, wherein the seat further includes a plate having an aperture therethrough and a locking pin extending through the aperture into one of the guide channels of the frame when the seat is in the reclined position.

33. The juvenile chair of claim 30, wherein the seat further includes a sleeve that extends about the aperture and is sized to receive the locking pin and the sleeve includes a flexible tab configured to engage the locking pin.

34. A juvenile chair comprising a frame being formed to include front legs coupled to a rear frame member, the front legs each being formed to include an upper portion, a lower portion, a guide channel extending between upper and lower portions, and height-position slots positioned to lie spaced apart from the guide channel, a seat including track guides, a plate having a guide post configured for selective sliding movement within one of the guide channels of the frame, and latches movably coupled to the seat for supporting the seat on the frame, each latch including a latch tooth configured to engage at least one of the height-position slots when the seat is mounted on the frame to block sliding movement of the guide in the guide channel toward the lower portion of the front legs.

35. The juvenile chair of claim 34, wherein the latches include an outer latch button coupled to the latch tooth and configured to move the latch tooth away from the height-position slots so that the seat is free to slide upon the front frame member relative to the upper and lower positions.

36. The juvenile chair of claim 34, wherein the track guides include an elongated guide block sized for sliding movement within the guide channel.

37. The juvenile chair of claim 36, wherein the frame includes a handle portion extending between the front legs and the seat includes a handle coupled thereto, and the handle of the seat is formed for selective engagement with the handle portion of the frame to position the seat in a reclined position.

38. A juvenile chair comprising a frame including a first guide channel, a seat formed to include a first guide positioned to move within the first guide channel, and a first latch coupled to the seat to engage the frame at a location adjacent to the first guide channel and block movement of the seat relative to the frame, the latch being separated from the first guide channel.

39. The juvenile chair of claim 38, wherein the frame includes spaced-apart height-position slots and the first latch engages the height-position slots to block movement of the seat relative to the frame.

40. The juvenile chair of claim 39, wherein the frame includes seven height-position slots.

41. The juvenile chair of claim 38, further comprising a second latch coupled to the seat, wherein the frame includes a second guide channel spaced apart from the first guide channel, the seat includes a second guide positioned to move within the second guide channel, the second latch is separated from the first and second guide channels and arranged to engage the frame to block movement of the seat relative to the frame.

42. The juvenile chair of claim 41, wherein the frame includes spaced-apart height-position slots and the first and second latches engage the height-position slots to block movement of the seat relative to the frame.

43. The juvenile chair of claim 38, wherein the frame includes a lower portion and an upper portion, the first latch includes a cam surface configured to move the first latch toward the seat in response to movement of the first guide in the first guide channel toward the upper portion of the frame.

44. The juvenile chair of claim 38, further comprising a spring extending between the first latch and the seat and the spring yieldably permits movement of the first latch toward the seat away from the frame in response to movement of the first guide in the first guide channel toward an upper portion of the frame.

45. The juvenile chair of claim 44, wherein the latch includes a latch tooth normally biased away from the seat by the spring into engagement with the frame.

46. The juvenile chair of claim 38, further comprising an outer latch button coupled to the first latch for disengaging the first latch from the frame so that the seat is released from a fixed pre-determined position and slides between a fully-lowered position and a fully-elevated position on the frame.

47. The juvenile chair of claim 38, wherein the first guide includes a plate extending from the seat and a guide post extending outwardly from the plate of the first guide and the guide post is sized for sliding movement in the guide channel of the frame.

48. The juvenile chair of claim 47, wherein the first guide further includes a guide block spaced-apart from the guide post and the guide block is sized for sliding movement in the respective first guide channel of the frame.

49. The juvenile chair of claim 38, wherein the first guide includes a guide post positioned to lie within the first guide channel to travel a length of the first guide channel.

50. The juvenile chair of claim 49, wherein the guide post is perpendicular to the length of the first guide channel.

51. The juvenile chair of claim 38, wherein the frame includes a pair a straight side walls defining the first guide channel.

52. The juvenile chair of claim 38, wherein the frame includes a pair of parallel side walls defining the first guide channel.

53. The juvenile chair of claim 38, wherein the frame includes a pair of uniformly spaced-apart side walls defining the first guide channel.

54. The juvenile chair of claim 38, wherein the first guide channel includes a guide-travel opening configured to receive the first guide therethrough during travel of the first guide relative to the frame and a guide-admitting opening configured to admit the first guide therethrough during insertion of the first guide into the first guide channel.

55. The juvenile chair of claim 54, wherein the first guide lies in spaced-apart relation to the guide-admitting opening during travel of the first guide in the first guide channel and guide-travel opening.

56. The juvenile chair of claim 38, wherein the first guide channel includes an open end.

57. The juvenile chair of claim 56, wherein the frame includes an upper portion and a lower portion and the open end is positioned to lie on the upper end of the frame.

58. The juvenile chair of claim 38, wherein the first guide channel includes a closed end.

59. The juvenile chair of claim 58, wherein the first guide channel includes an open end spaced apart from the closed end.

60. A juvenile chair comprising a frame including a first leg including a first guide channel and a second leg including a second guide channel, a seat formed to include a first guide positioned to move within the first guide channel and a second guide positioned to move within the second guide channel, and a first latch coupled to the seat to engage the frame to block movement of the seat relative to the frame, the first latch being separated from the first and second guide channels.

61. The juvenile chair of claim 60, wherein the frame includes spaced-apart height-position slots and the first latch engages the height-position slots to block movement of the seat relative to the frame.

62. The juvenile chair of claim 60, further comprising a second latch coupled to the seat, the second latch is separated from the first and second guide channels and arranged to engage the frame to block movement of the seat relative to the frame.

63. The juvenile chair of claim 62, wherein the frame includes spaced-apart height-position slots and the first and second latches engage the height-position slots to block movement of the seat relative to the frame.

64. The juvenile chair of claim 60, wherein the first guide includes a first guide post positioned to lie within the first guide channel and the second guide includes a second guide post positioned to lie with the second guide channel.

65. The juvenile chair of claim 64, wherein the first and second guide posts are coaxial.

66. The juvenile chair of claim 60, wherein the first guide includes a guide post positioned to lie within the first guide channel and the guide post is perpendicular to a length of the first channel guide traveled by the guide post.

67. The juvenile chair of claim 60, wherein the first guide channel includes a guide-travel opening configured to receive the first guide therethrough during travel of the first guide relative to the frame and a guide-admitting opening configured to admit the first guide therethrough during insertion of the first guide into the first guide channel.

68. The juvenile chair of claim 60, wherein the first guide channel includes an open end.

69. The juvenile chair of claim 60, wherein the first guide channel includes a closed end.

70. The juvenile chair of claim 69, wherein the first guide channel includes an open end spaced apart from the closed end.

71. The juvenile chair of claim 60, wherein the frame includes a handle portion extending between the first and second legs, the seat includes a seat bottom and a seat back extending from the seat bottom and a handle mounted on the seat back, and the handle engages the handle portion when the seat is mounted on the frame in a reclined position.

72. The juvenile chair of claim 71, wherein the first guide includes a plate having an aperture therethrough and a locking pin extending through the aperture into the first guide channel of the frame when the seat is in the reclined position.

73. The juvenile chair of claim 72, wherein the first guide further includes a sleeve that extends about the aperture and is sized to receive the locking pin and the sleeve includes a flexible tab configured to engage the locking pin.

74. The juvenile chair of claim 71, wherein the first guide further includes a guide post coupled to the plate and positioned to lie in the first guide channel.

75. The juvenile chair of claim 60, wherein the frame includes rear legs, the first and second legs are front legs pivotally coupled to the rear legs so that the frame is movable between an expanded position and a folded position.

76. The juvenile chair of claim 75, further comprising frame latches, the front legs are formed to include an aperture therethrough and the rear legs are formed to include a pair of opposing holes therethrough, the frame latches are sized for selective extension through the holes and the aperture and engagement with the front legs to couple the front and rear legs together when the frame is in the expanded position.

77. The juvenile chair of claim 76, wherein the front legs are formed to include a ramped portion positioned to guide movement of each frame latch into the respective hole of the rear leg during movement from the folded position to the expanded position.

78. The juvenile chair of claim 75, wherein the front legs are formed to include an aperture therethrough and the rear legs include a flexible tab member sized for selective extension through the aperture and engagement with the front legs to couple the front and rear legs together when the frame is in the expanded position.

79. A juvenile chair comprising a frame formed to include a pair of straight side walls cooperating to define a guide channel, a seat including a guide traveling in the guide channel, the guide channel being open along a length of the guide channel traveled by the guide, and a latch coupled to the seat to move relative to the seat to engage the frame to block travel of the guide in the guide channel and movement of the seat relative to the frame.

80. The juvenile chair of claim 79, wherein the side walls are parallel.

81. The juvenile chair of claim 79, wherein the side walls are uniformly spaced apart.

82. The juvenile chair of claim 79, wherein the guide channel includes a guide-travel opening configured to receive the guide therethrough during travel of the guide relative to the frame and a guide-admitting opening configured to admit the guide therethrough during insertion of the guide into the guide channel.

83. The juvenile chair of claim 82, wherein the guide is spaced apart from the guide-admitting opening during travel of the guide in the guide-travel opening.

84. The juvenile chair of claim 79, wherein the guide channel includes an open end.

85. The juvenile chair of claim 79, wherein the guide channel includes a closed end.

86. The juvenile chair of claim 79, wherein the frame is formed to include height-position slots and the latch engages at least one of the height-position slots of the frame to block travel of the seat relative to the frame.

87. The juvenile chair of claim 86, wherein the height-position slots are separated from the guide channel.

88. The juvenile chair of claim 79, wherein the guide is perpendicular to the length of the guide channel.

89. A juvenile chair comprising a frame including a leg having an upper end, a lower end, and a guide channel extending between the upper and lower ends, a seat including a guide traveling in the guide channel, the guide channel including a guide-travel opening extending along the length of the guide channel traveled by the guide during travel of the guide relative to the frame, the guide channel also including a guide-admitting opening formed in the upper end of the guide channel and configured to admit the guide into the guide channel, and a latch movably coupled to the seat and arranged to move relative to the seat to engage the frame to block travel of the guide in the guide channel and movement of the seat toward the lower end of the leg.

90. The juvenile chair of claim 89, wherein the leg further includes an upper end surface positioned on the upper end of the leg and the guide channel extends to the upper end surface of the leg to define the guide-admitting opening.

91. The juvenile chair of claim 89, wherein the guide channel includes a closed end on the lower end of the leg.

92. The juvenile chair of claim 89, wherein the leg includes a pair of straight side walls defining the guide channel.

* * * * *